United States Patent [19]

Csanady et al.

[11] 4,025,370

[45] May 24, 1977

[54] DOUBLE BASE PROPELLANT CONTAINING AZOBISFORMAMIDE

[75] Inventors: Elmer R. Csanady, Forest Heights; Paul R. Mosher, Indian Head; Albert T. Camp, Welcome, all of Malagasy Republic

[73] Assignee: The United States of America as represented by the Secretary of the Navy, Washington, D.C.

[22] Filed: Apr. 4, 1974

[21] Appl. No.: 459,421

[52] U.S. Cl. ..... 149/92; 149/88; 149/98; 149/100

[51] Int. Cl.[2] ..... C06B 25/34

[58] Field of Search ..... 149/98, 88, 100, 92

[56] References Cited

UNITED STATES PATENTS 3,834,956 9/1974 Mellow et al. ..... 149/98 X

*Primary Examiner*—Stephen J. Lechert, Jr.
*Attorney, Agent, or Firm*—R. S. Sciascia; A. L. Branning

[57] ABSTRACT

The addition of azobisformamide to a double base propellant in order to (1) shift the plateau pressure-burning rate relationship of a double base propellant modified by any of the commonly used copper and lead organo salts and (2) increase the volume and nitrogen content of the exhaust gas of the propellant.

8 Claims, 3 Drawing Figures

DOUBLE BASE PROPELLANT CONTAINING AZOBISFORMAMIDE

BACKGROUND OF THE INVENTION

The invention relates generally to gas producing compositions and more particularly to double base propellants having a plateau pressure-burning rate relationship.

Solid propellants are often classified as being either homogeneous or composite. The former refers to those types, which are considered true monopropellants in which each molecule contains all the necessary fuel and oxygen for combustion. The composite type propellant, in contrast, consists of a physical mixture of a fuel and an oxidizer. The homogeneous propellants are further subclassified as being either single, or double base, depending on whether the composition contains a single energetic combustible or contains an additional energetic combustible or a mixture of additional energetic combustibles which acts as an energetic plasticizer for the first energetic combustible.

The burning rate equation for double base propellants is given as $r = KP^n$ or $\log r = n \log P + \log K$ where $r$ is the burning rate, P is the combustion chamber pressue, K is a constant for each propellant composition, and n is a constant for non-modified propellants but is a variable function in plateau propellants varying from very high positive values through zero to low negative values. Thus, a plot of log $r$ against log P would give a straight line with a slope of n for a non-modified propellant, but a "plateau" shaped line for plateau propellants. Plateau propellants are also frequently referred to as modified propellants. In this patent application modified double base propellant means the same as plateau double base propellant.

The plateau logarithmic relationship between the burning rate and the chamber pressure is greatly preferred over the linear logarithmic one. Such a relationship gives better ballistic and combustion stability, less dependence on initial temperature, and lower peak pressures in the combustion chamber.

In order to obtain the plateau relationship, additives referred to as ballistic modifiers are included in the propellant composition. These additives accelerate the burning rate at low pressures but have a decreasing catalytic effect as the chamber pressure increases up to a certain pressure. As the catalytic effect diminishes, the rate-pressure relationship slowly approaches the rate-pressure relationship for the propellant without the modifier. Sometimes the rate-pressure function for the plateau propellant actually drops below that of the unmodified propellant.

The location of the "plateau" on a log-log graph of the pressure-burning rate relationship is important for certain applications. For example, it is often desirable to have the "plateau" phenomena to occur as soon as possible in propellants for auxiliary gas generating equipment. It is also desirable to be able to adjust the plateau rate level vertically.

Certain control over the location of the plateau can be achieved by carefully formulating the propellant or selecting a particular ballistic modifier. Such changes often cause new problems which would not have occurred if the placing of the "plateau" was achieved by the addition of another ingredient.

However desirable the plateau pressure-burning rate relationship may be, it is often sacrificed in order to obtain other propellant properties. Two such properties are high volume of, and nitrogen content in, the exhaust gas of the propellant combustion.

Nitrogen is considered the ideal exhaust or working gas because it is smokeless, does not flash, does not dissociate, is not toxic, and has a favorable molecular weight. The number of moles of exhaust gas is inversely proportional to the average molecular weight of the exhaust gas. Hence a large proportion of nitrogen in the exhaust gas means a large volume for the exhaust gas. These properties of nitrogen are especially important for auxiliary gas producing equipment.

SUMMARY OF THE INVENTION

Accordingly one of the objects of this invention is to provide a double base propellant with a "plateau" burning profile.

Another object of this invention is to provide a modified double base propellant with an increased exhaust gas volume.

Another object of this invention is to provide a modified double base propellant with a low corrosive exhaust gas.

A further object of this invention is to provide a modified double base propellant with an increased nitrogen content in its exhaust gas.

Also an object of this invention is to provide an adjuvant to lead and copper organo salt modifiers which shifts the plateau pressure-burning rate relationship, either horizontally or vertically as necessary.

These and other objects can be achieved by the addition of axobisformamide which acts as a source of controlled gasification to a double base propellant having a lead or copper organo salt modifier.

DESCRIPTION OF THE PREFERRED EMBODIMENTS

Figure 1:
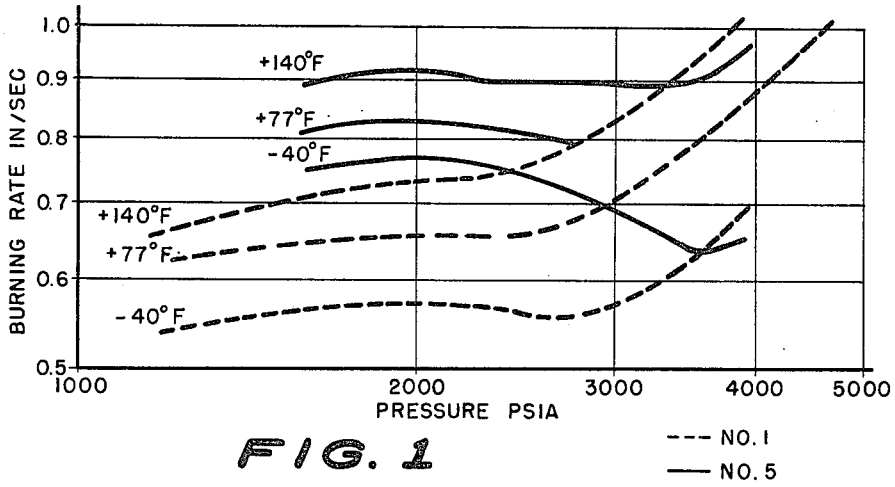
FIG. 1 compares the pressure-burning rate relationship of comparable modified NC—NG propellant compositions, one with and one without azobisformamide, over a temperature range of −40° to +140° F.

According to modern theory the organic salts of lead and copper which are typically used as ballistic modifiers achieve their effect by being transformed into free metal vapor states and thereby emitting ultraviolet rays into the combustion reaction. The nonmetallic gaseous products of combustion are generally rated as poor radiation emitters. Thus an additive which increases the volume of gaseous products might tend to vitiate the effect of the ballistic modifier. But azobisformamide does not. Instead of destroying the ballistic modification of these organic salts, azobisformamide alters the ballistic modification while significantly increasing the volume of exhaust gas and the proportion of nitrogen in the exhaust gas. A possible explanation for this surprising result is that the gasification of azobisformamide is triggered and controlled to a significant degree by ultraviolet radiation. Hence the azobisformamide is prevented from drowning out the effect of the lead and opper organic salts while affecting the porosity of the oam and fizz zones of the propellant's combustion.

The amount of azobisformamide to be used accordng to this invention is from about 0.05 to about 5 eight percent of the total composition. The preferred mount of azobisformamide to be used is from about 2 about 4.5 weight percent with 3.0 to 4.0 weight ercent of the total composition being the most preerred.

The copper and lead organo salt ballistic modifiers to e used with azobisformamide are for example the ormal lead salt of 4-acetomide-salicylic acid, copper nd lead salts, normal and monobasic, of salicylic, β-esorcylic, 2,5-dihydroxybenzoic, and 5-methylene lisalicylic acids mixtures thereof and the like. The allistic modifiers may be used in an amount from bout 0.2 to about 5 weight percent with about 0.5 to bout 4 weight percent of the total composition preerred. Preferably the ballistic modifier is monobasic upric β-resorcylate (MBCBR) in an amount between bout 0.2 to about 2 weight percent of the total compoition and most preferably in an amount from 0.7 to 1 veight percent.

The double base propellants which may be modified y azobisformamide in conjuction with any of the bove identified copper and lead organo salts contain a arge number of art recognized double base propellant ngredients. The first energetic combustible may be itrocellulose (NC), plastisol nitrocellulose (PNC), olyvinyl nitrate (PVN), mixtures thereof and the like. Preferably nitrocellulose is used and has a nitration between 12 and 13% and a viscosity of 1 to 25 seconds by standard test of a 10% solution in acetone and alcohol. The amount of nitrocellulose may be about 35 to about 65 weight percent with 40 to 55 weight percent preferred.

The second energetic combustible may be nitroglycerin; and other secondary nitrate ester plasticizers. The amount to be used is from about 25 to 50 percent with 35 to 45 weight percent of total composition preferred. If monobasic cupric β-resorcylate is the ballistic modifier, superior plateaus may be obtained even when the second energetic combustible is a primary bonded nitrate ester such as pentaerythritol trinitrate (PETRIN), diethylene glycol dinitrate (DEGN), metriol trinitrate (MTN), which is also known as 1,1,1trimethylolethane, triethylene glycol dinitrate (TEGDN), mixtures thereof, and the like. The preferred second energetic combustible is a mixture of MTN and TEGDN in a MTN/TEGDN ratio of about 4:1 to about 10:1 with 7:1 to 8:1 the most preferred. The amounts to be used can be about 20 to about 60 weight percent of MTN with 30 to 50 weight percent the most preferred and 2 to 15 weight percent of TEGDN with 4 to 10 weight percent the most preferred.

The preferred stabilizer for the propellants encompassed by this invention is 2-nitrodiphenylamine (2-NDPA) or ethyl centralite (EC) in an amount of about 0.5 to about 5 weight percent with 1.5 to 3.0 weight percent the most preferred. Other good stabilizers are N-alkyl paranitroanilines.

A nonenergetic plasticizer may also be used with this invention such as di-n-propyl adipate, metriol triacetate, or dibutylphthylate. The preferred nonenergetic plasticizer would be di-n-propyl adipate (di-n-PA) in an amount from about 1 to about 5 weight percent with 1 to 3 weight percent preferred.

Other ingredients may be used to adapt the propellant to a particular processing method or a particular use. For example candellilla wax may be added as an extrusion aid.

The use of azobisformamide does not present any processing problems. Any process which would be suitable for preparing a particular composition can still be used after azobisformamide has been included in the composition. If a mixture of metriol trinitrate and triethylene glycol dinitrate is used as the second energetic combustible, the nitrocellulose is plasticized sufficiently to be processed by these two nitrate esters without the need of any solvent. Hence any standard solventless process may be used.

A solventless method of preparation is to be preferred over solvent method of preparation because solvent processes are more time consuming and difficult. Further a solventless method gives a high quality homogeneous product.

By way of example the following method of preparation is given. Nitrocellulose, warm water, and 2-NDPA are mixed to a fine slurry. Next the mixture of metriol trinitrate and triethylene glycol dinitrate is slowly added to the slurry. Thereafter the slurry is dried and aged for at least one day at a temperature around 130° F. Further drying reduces the moisture content to around 10%. At this time monobasic cupric β-resorcylate and azobisformamide are added and the mixture is milled to a homogeneous colloid on a differential rolling mill and finally blended on even-speed rolling mills if desired. If extrusion is desired, the propellant can be easily extruded to any desired shape in a standard evacuated extruders.

The general nature of the invention having been set forth the following examples are presented as specific illustrations thereof.

TABLE I

| COMPOSITION | COMPOSITION (WEIGHT PERCENT OF TOTAL COMPOSITION) Ex. 1 | Ex. 2 | Ex. 3 | Ex. 4 |
|---|---|---|---|---|
| NC (12.6%N) | 49.0 | 49.0 | 49.0 | 40.0 |
| NG | 39.4 | 39.4 | 41.0 | — |
| MTN | — | — | — | 47.0 |
| TEGDN | — | — | — | 6.0 |
| 2-NDPA | 2.0 | 2.0 | 2.0 | 1.5 |
| di-nPA | 4.5 | 2.5 | 3.0 | 1.5 |
| AS-9* | — | 2.0 | — | — |
| MBCBR | 1.0 | 1.0 | 1.0 | 1.0 |
| Azobisformamide | 4.0 | 4.0 | 4.0 | 3.0 |
| Candellilla Wax | 0.1 | 0.1 | — | — |

*normal lead salt of 4-acetamido salicylic acid.

For the purpose of showing the effect of azobisformamide on the plateau profile of the burning rate v. pressure graph of a composition the following two non azobisformamide propellants are given.

TABLE II

| INGREDIENT | Ex. 5 | Ex. 6 |
|---|---|---|
| NC(12.6% N) | 51.0 | 40.0 |
| NG | 40.0 | — |
| MTN | — | 50.0 |
| TEGDN | — | 7.0 |
| Di-n-PA | 6.0 | — |
| 2NDPA | 2.0 | 2.0 |
| MBCBR | 1.0 | 1.0 |

Figure 2:
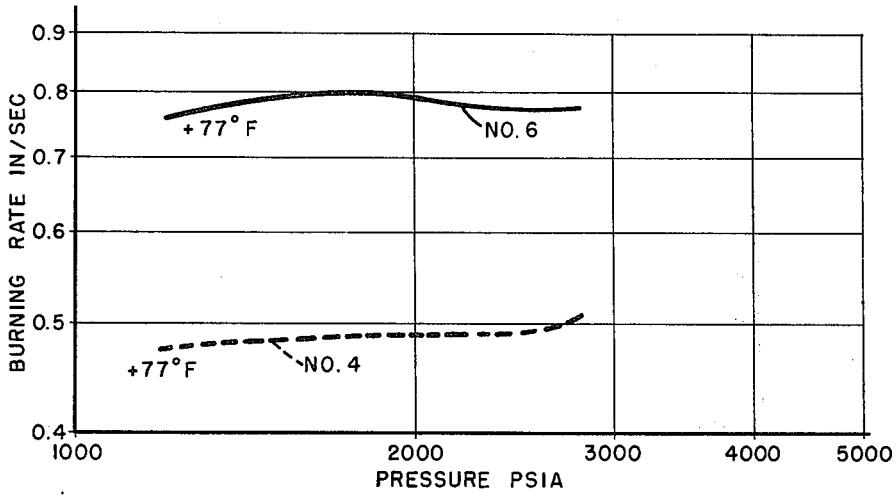
FIG. 2 compares the pressure-burning rate relationship of comparable modified NC—MTN/TEGDN propellant compositions, one with and one without azobisformamide.
Figure 3:
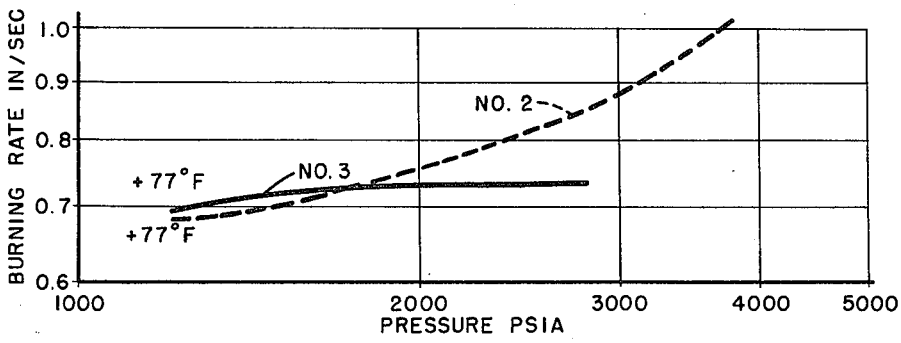
FIG. 3 shows the pressure-burning rate relationship of two modified propellant compositions with azobisformamide.

The effect and advantages of the invention are shown in FIGS. 1–3. All of the figures are graphs of the pressure-burning rate relationships for the various propellants tested. The data for the curves of the pressure-burning rate relationship were obtained by standard techniques. Strands of propellant were burned in a Crawford bomb. Recordings were made of the time, length of strand, and the nitrogen gas pressure inside of the bomb. From this data the burning rates and the average recorded pressures were calculated.

FIG. 1 shows the log-log graph of the ballistic data of two comparable modified NC-NG propellants which differ by the inclusion of azobisformamide in propellant No. 1. It is apparent from the figure that the inclusion of azobisformamide causes the catalytic effect of the copper organo salt modifier to become effective sooner but also diminishes the effectiveness of the ballistic modifier sooner. The net effect is that the plateau pressure-burning rate relationship is shifted down and to the left. Also the graph shows that the addition of azobisformamide does not appreciably affect the insensitivity of a propellant composition to large changes in the initial temperature. A composition such as composition No. 1 would be useful as a low pressure propellant of the type used in auxiliary gas generating equipment. The effectiveness of such a composition for such uses is further enhanced by the increase in volume and nitrogen content of the exhaust caused by the addition of azobisformamide.

The pressure-burning rate curves of FIG. 2 show the effectiveness of azobisformamide in a propellant composition in which the nitrocellulose is plasticized by nitrate esters having only primary nitroxy groups. Propellant composition No. 4 has azobisformamide while propellant composition No. 6 does not. As can be seen from FIG. 2, the alteration of the plateau pressure-burning rate relationship is similar to that caused in NC-NG propellants by the addition of azobisformamide. Owing to the superiority of this type of double base propellant over the NC-NG propellant in many respects, the capability of azobisformamide of functioning in this type of propellant composition is of great importance to the propellant art.

FIG. 3 shows the graphs of the pressure-burning rate relationship of two additional preferred modified propellant compositions which have azobisformamide as an ingredient.

Obviously, many modifications and variations of this invention are possible in the light of the above teachings. It is therefore to be understood that within the scope of the appended claims the invention may be practiced otherwise than as specifically described.

What is claimed as new and desired to be secured by Letters Patent of the United States are:

1. In a double base propellant containing a ballistic modifier the improvement comprising the addition thereto of azobisformamide in an amount from about 0.5 to about 5.0 weight percent of the total composition.

2. The propellant of claim 1 wherein the amount of azobisformamide added is from about 2 to about 4.5 weight percent of the total composition.

3. The propellant of claim 1 wherein the amount of azobisformamide added is from 3.0 to 4.0 weight percent of the total composition.

4. A double base propellant comprising nitrocellulose in an amount from about 35 to about 65 weight percent of total composition; nitroglycerin in an amount from about 25 to about 50 weight percent of total composition; a stabilizer selected from the group consisting of 2-nitrodiphenylamine and ethyl centralite in a amount between about 0.5 to about 5.0 weight percent of total composition; di-n-propyl adipate in an amount from about 1 to about 5 weight percent of total composition; a ballistic modifier selected from the group consisting of normal lead salt of 4-acetomido salicylic acid, copper and lead salts, normal and monobasic, of salicylic, β-resorcylic, 2,5-dihydroxybenzoic, and 5-methylene disalicylic acids, and mixtures thereof in an amount from about 0.2 to about 5.0 weight percent of total composition; and azobisformamide to an amount from about 0.5 to about 5 weight percent of total composition.

5. The composition of claim 4 wherein the amount of nitrocellulose is between 40 and 55 weight percent of total composition; the amount of nitroglycerin is between 35 and 45 weight percent of total composition, the ballistic modifier is monobasic cupric β-resorcylate in an amount from 0.7 to 1 weight percent of total composition of azobisformamide is from 3 to 4 weight percent of total composition.

6. A solventless double base propellant comprising, based on total composition weight, from about 35 to about 65 weight percent of nitrocellulose; from about 20 to about 60 weight percent of metriol trinitrate, from about 2 to about 15 weight percent of triethylene glycol dinitrate; from about 0.5 to about 5 weight percent of a stabilizer selected from the group consisting of 2-nitrodiphenylamine, ethyl centralite and mixtures thereof; from about 1 to about 5 weight percent of di-n-propyl adipate; from 0.2 to 2 weight percent of monobasic cupric β-resorcylate; and from about 0.05 to about 5 weight percent of azobisformamide.

7. The propellant of claim 6 wherein the amount of nitrocellulose is from 40 to 55 weight percent, the amount of metriol trinitrate is from 30 to 50 weight, the amount of triethyleneglycol dinitrate is from 4 to 10 weight percent, the stabilizer is 2-nitrodiphenylamine in amount from 1.5 to 3 weight percent, the amount of di-n-propyl adipate is from 1 to 3 weight percent, the amount of monobasic cupric β-resorcylate is 0.7 to 1 weight percent, and the amount of azobisformamide is from 2 to 4.5 weight percent.

8. The propellant of claim 7 wherein the amount of azobisformamide is from 3 to 4 weight percent.

* * * * *